US009127835B2

(12) United States Patent
Tanaka et al.

(10) Patent No.: US 9,127,835 B2
(45) Date of Patent: Sep. 8, 2015

(54) BOILER STEAM AMOUNT MEASURING METHOD, BOILER LOAD ANALYZING METHOD, BOILER STEAM AMOUNT MEASURING APPARATUS, AND BOILER LOAD ANALYZING APPARATUS

(75) Inventors: Osamu Tanaka, Ehime (JP); Tetsuji Namoto, Ehime (JP); Noriaki Nagai, Ehime (JP)

(73) Assignee: MIURA CO., LTD., Matsuyama (JP)

( * ) Notice: Subject to any disclaimer, the term of this patent is extended or adjusted under 35 U.S.C. 154(b) by 326 days.

(21) Appl. No.: 13/592,731

(22) Filed: Aug. 23, 2012

(65) Prior Publication Data

US 2013/0074608 A1 Mar. 28, 2013

(30) Foreign Application Priority Data

Sep. 28, 2011 (JP) ..... 2011-212674

(51) Int. Cl.
*F22B 37/38* (2006.01)

(52) U.S. Cl.
CPC ..... *F22B 37/38* (2013.01)

(58) Field of Classification Search
CPC ..... C12P 7/04; F23L 7/007; A23L 1/0121; A47J 37/041; A61K 36/06; G01F 1/34; G01F 1/40; G01F 1/363; G01F 1/36; G01F 1/74; F23J 2219/10; F23N 1/022; F23N 2041/04; F23N 5/006; F24H 1/403; G01N 33/2841; G01N 7/14; G01N 33/18; G01N 1/2294; G01N 33/0004; F22B 37/38
USPC ..... 73/861.42, 861.49, 861.46, 19.01, 73/19.05, 19.1
See application file for complete search history.

(56) References Cited

U.S. PATENT DOCUMENTS

| | | | | |
|---|---|---|---|---|
| 4,556,018 | A * | 12/1985 | Agata | 122/35 |
| 5,591,922 | A * | 1/1997 | Segeral et al. | 73/861.04 |
| 2005/0284346 | A1* | 12/2005 | Hayashi | 110/343 |
| 2007/0163362 | A1* | 7/2007 | Wehrs et al. | 73/861.42 |
| 2011/0005337 | A1* | 1/2011 | Mattar et al. | 73/861.354 |
| 2012/0180547 | A1* | 7/2012 | Lawrence | 73/1.35 |
| 2012/0323530 | A1* | 12/2012 | Mazzaro et al. | 702/182 |

FOREIGN PATENT DOCUMENTS

| | | | |
|---|---|---|---|
| JP | S56-031606 | A | 3/1981 |
| JP | H09-119602 | A | 5/1997 |
| JP | B2-2737753 | | 4/1998 |
| JP | A-2010-139207 | | 6/2010 |
| JP | 2010-205551 | A | 9/2010 |

* cited by examiner

*Primary Examiner* — Peter Macchiarolo
*Assistant Examiner* — Mohammed Keramet-Amircola
(74) *Attorney, Agent, or Firm* — Oliff PLC

(57) ABSTRACT

A boiler steam amount measuring method for continuously measuring a temporal change in an amount of steam from a steam boiler, includes: first measuring a differential pressure between a pressure at a first detection position that is a predetermined position in a can body of the steam boiler or a steam outflow path, and a pressure at a second detection position in the steam outflow path separated from the first detection position toward a downstream side; first calculating a pressure loss coefficient based on the differential pressure measured by flowing a predetermined flow rate of steam or fluid instead of steam into the steam outflow path, and the predetermined flow rate; and second calculating continuously the amount of steam based on the differential pressure measured in the first measuring and the pressure loss coefficient calculated in the first calculating, and outputting the calculated amount of steam as a measurement value.

6 Claims, 3 Drawing Sheets

BOILER STEAM AMOUNT MEASURING METHOD, BOILER LOAD ANALYZING METHOD, BOILER STEAM AMOUNT MEASURING APPARATUS, AND BOILER LOAD ANALYZING APPARATUS

CROSS-REFERENCE TO RELATED APPLICATION(S)

This application is based upon and claims the benefit of priority from Japanese Patent Application No. 2011-212674, filed on Sep. 28, 2011, the entire contents of which are incorporated herein by reference.

FIELD

The present invention relates to a boiler steam amount measuring method, a boiler load analyzing method, a boiler steam amount measuring apparatus and a boiler load analyzing apparatus.

BACKGROUND

There are conventionally known simplified steam amount measuring methods for measuring the amount of steam without using a steam flow meter. A first conventional method is directed for calculating the amount of steam by use of a direct fuel flow signal by a fuel flow meter. A second conventional method is directed for measuring an exhaust gas flow velocity in a flue based on a difference between a total pressure and a static pressure by a pitot tube, calculating a fuel flow rate, and estimating the amount of steam by use of an indirectly-calculated fuel flow signal. Both the first and second conventional methods are the methods for estimating the amount of steam based on the amount of input/output heat into/from a boiler.

The conventional methods for calculating the amount of steam based on the amount of input/output heat into/from a boiler as the first and second conventional methods have the following problem. That is, a temporally-changing velocity is different between a steam amount estimation based on the amount of input/output heat into/from a boiler and an actual steam amount measurement, and thus the ever-changing amount of steam cannot be measured without a response delay. For example, if a variation in intermittently supplied water, intermittent blow or supplied water temperature in a boiler occurs during a measurement, a temporal change in the amount of steam cannot be precisely measured (because a delay due to transmitted heat, accumulated heat or radiated heat is present).

The first and second conventional steam amount estimating methods have the problem that when a fuel property value such as the amount of generated heat, which is important data for estimating the amount of steam based on the amount of input/output heat into/from a boiler, changes, the estimated amount of steam changes. Particularly, in coal burning overseas, although it depends on the kind of coal, the amount of water has a large effect on outdoor crushed coal immediately before actual use, and thus the fuel property value changes. Therefore, the amount of generated heat and the amount of theoretical exhaust gas change and thus the estimated amount of steam changes.

SUMMARY OF THE INVENTION

A boiler steam amount measuring method for continuously measuring a temporal change in an amount of steam from a steam boiler, comprises: first measuring a differential pressure between a pressure at a first detection position that is a predetermined position in a can body of the steam boiler or a steam outflow path of the steam boiler, and a pressure at a second detection position in the steam outflow path separated from the first detection position toward a downstream side of the steam boiler; first calculating a pressure loss coefficient based on the differential pressure measured by flowing a predetermined flow rate of steam or fluid instead of steam into the steam outflow path, and the predetermined flow rate; and second calculating continuously the amount of steam based on the differential pressure measured in the first measuring and the pressure loss coefficient calculated in the first calculating to output the calculated amount of steam as a measurement value.

DETAILED DESCRIPTION OF THE PREFERRED EMBODIMENTS

Figure 1:
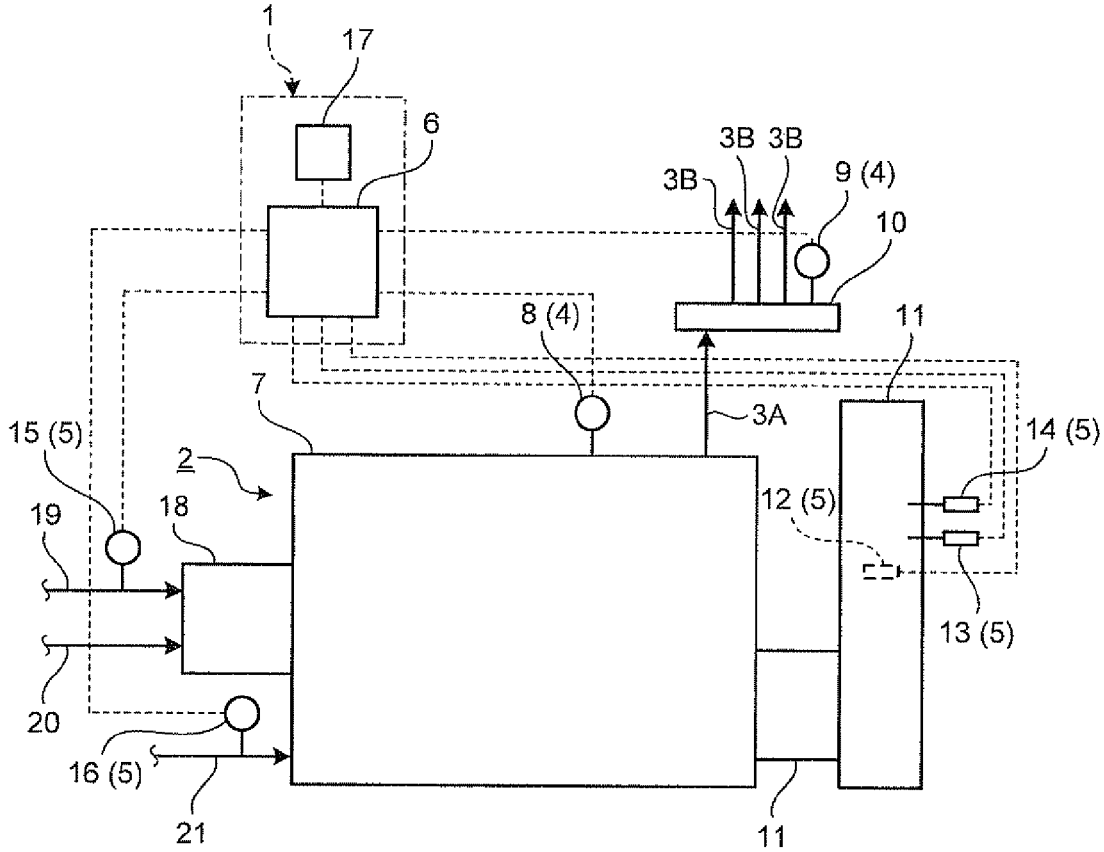
FIG. 1 is an exemplary schematic structure diagram of a steam amount measuring apparatus according to a first embodiment of the present invention.

There will be described below a boiler steam amount measuring method according to embodiments of the present invention. The embodiments according to the present invention relate to a boiler steam amount measuring method for measuring an amount of steam without using a steam flow meter. The problems to be solved by the embodiments are to measure the ever-changing amount of steam without a response delay not by using a steam flow meter, and to more accurately calculate the amount of steam even when a fuel property value changes as compared with the conventional methods. The embodiments are preferably implemented on a steam amount measuring apparatus used for an existing steam boiler. The steam boiler may be a boiler for burning gas fuel, liquid fuel or solid fuel, as well as an electric boiler and an exhaust gas boiler.

The embodiments will be described specifically. The embodiments are for a boiler steam amount measuring method for continuously measuring a temporal change in the ever-changing amount of steam X in a steam boiler (which will be simply called boiler below). The amount of steam can be called the amount of generated steam or a steam flow rate.

The embodiments are characterized by a differential pressure measuring step, a pressure loss coefficient calculating step, and a steam amount calculating/outputting step described later. Each step will be described below.

Differential Pressure Measuring Step

The differential pressure measuring step is a step of measuring a differential pressure $\Delta P$ ($=P\mathbf{1}-P\mathbf{2}$) between a pressure P1 at a first detection position as a predetermined position in the boiler can body or a steam outflow path (which can be called steam outflow pipe or steam outflow pipe path) from the can body, and a pressure P2 at a second detection position in the steam outflow path separated from the first detection position toward the downstream side.

The first detection position can be inside the can body. The second detection position can be also at a steam header. Of course, the first detection position and the second detection position can be in the steam outflow path not in the can body or at the steam header. The steam header is a steam collecting part for storing steam from the boiler and distributing it to steam using devices.

Pressure Loss Coefficient Calculating Step

The pressure loss coefficient calculating step is a step (which is called first calculating step) of calculating a pressure loss coefficient K based on the differential pressure ΔP measured by flowing a predetermined flow rate of steam in the steam outflow path, and the predetermined flow rate. However, it may be a step (which is called second calculating step) of calculating a pressure loss coefficient K based on the differential pressure ΔP measured by flowing a predetermined flow rate of fluid (gas or liquid) instead of steam in the steam outflow path, and the predetermined flow rate.

The first calculating step will be described first. The calculating step includes a calculation source data measuring step of measuring calculation source data of a reference amount of steam X0 of the steam boiler, a reference steam amount calculating step of obtaining the reference amount of steam X0 based on the measured calculation source data, and a coefficient calculating step of calculating the pressure loss coefficient K based on the pressure loss calculation equation 1 in the following Equation (1) from the differential pressure ΔP when the reference amount of steam X0 is obtained. Assuming that the total sum of loss elements such as a valve and bending of the flow pipe path is K, a pressure loss is expressed in Equation (1).

$$\Delta P = K \times X^2 \div \rho \quad (1)$$

where ρ is a steam weight volume ratio (which can be calculated by using of a relational equation of only an existing steam pressure) at pressure 21 (or an average of 21 and 22).

Equation (1) is a pressure loss calculation equation obtained by substituting the calculated Equation (B) of the amount of steam X into the pressure loss calculation Equation (A) typically used as the relationship with the velocity V.

$$\Delta P = K' \times \rho \times V^2/2 \quad (A)$$

$$X = \pi R^2 \times \rho \times V \quad (B)$$

where R is an in-pipe radius of the steam outflow path.

$$\Delta P = (K'/2\pi^2 R^4) \times X^2 \div \rho = K \times X^2 \div \rho$$

where $$K = K'/2\pi^2 R^4$$

The pressure loss calculation equation is expressed in the relational equation with the amount of steam X in Equation (1), but is not limited thereto.

The calculation source data in the reference steam amount calculating step is data capable of calculating the reference amount of steam X0. The calculation source data is preferably a fuel flow rate (which can be called the amount of used fuel) N in the fuel flow path to the boiler, or an exhaust gas flow velocity M in an exhaust gas flow path in the boiler. However, any data capable of being easily measured and calculating the reference amount of steam V0, other than the fuel flow rate N and the exhaust gas flow velocity M, may be employed, not limited to the fuel flow rate N and the exhaust gas flow velocity M. For example, in case of a boiler for continuously controlling supplied water, the reference amount of steam X0 can be calculated based on a supplied water amount measurement. The calculation source data does not mean only the fuel flow rate N or the exhaust gas flow velocity M, but contains other items of data which need to be measured for calculating the reference amount of steam X0.

The calculation source data is necessary for calculating the reference amount of steam X0 as source data for calculating the pressure loss coefficient K described later, and thus does not need to be measured after the pressure loss coefficient K is calculated. As expressed in Equation (1), the reference amount of steam X0 can be calculated irrespective of fuel-system and burning-system effects after the pressure loss coefficient K is calculated if only a steam weight volume ratio indicating a steam state is known. Of course, the calculation source data may be measured as needed even after the pressure loss coefficient K is calculated.

The pressure loss coefficient calculating step includes a step of obtaining the amount of input heat Q based on the measured calculation source data (the fuel flow rate N and the exhaust gas flow velocity M) and obtaining the reference amount of steam X0 based on the obtained amount of input heat Q.

There is known in Japanese Patent No. 2737753 Publication and the like a method for obtaining the amount of input heat Q based on a fuel flow rate N as the calculation source data and obtaining the reference amount of steam X0 based on the obtained amount of input heat Q. In the embodiments, as described in Japanese Patent No. 2737753 Publication, a fuel flow rate N can be measured by the fuel flow meter provided in the boiler fuel flow path and the reference amount of steam X0 can be calculated in the following equation. The fuel in Japanese Patent No. 2737753 Publication is a liquid fuel.

The amount of input heat $Q$=fuel flow rate $N$×fuel specific gravity×fuel lower heating value(the amount of fuel low generated heat)

The reference amount of steam $X0$=the amount of input heat $Q$×boiler efficiency÷enthalpy increment There is known in Japanese Patent Application Laid-open No. 2010-139207 Publication a method for obtaining the amount of input heat Q by measuring an exhaust gas flow velocity M as the calculation source data and obtaining the reference amount of steam X0 based on the obtained amount of input heat Q. With the embodiments, as in Japanese Patent Application Laid-open No. 2010-139207 Publication, an exhaust gas flow velocity M is measured, and at the same time, an oxygen concentration or carbon dioxide concentration can be measured for calculating an exhaust gas temperature and an air ratio (air excess ratio), a fuel flow rate N can be calculated, and finally the reference amount of steam X0 can be calculated.

In the embodiments, the method for obtaining the reference amount of steam X0 is not characteristic of the present invention. The method for obtaining the reference amount of steam X0 by measuring an exhaust gas flow velocity M according to the present embodiments is not limited to the method in Japanese Patent Application Laid-open No. 2010-139207 Publication. Unlike Japanese Patent Application Laid-open No. 2010-139207 Publication, an exhaust gas flow velocity M can be measured by an impeller exhaust gas velocity meter or heat-wire velocity meter used for an anemometer, not by a pitot tube. The equation for calculating the reference amount of steam X0 is not limited to the equation in Japanese Patent Application Laid-open No. 2010-139207 Publication.

The reference amount of steam X0 is the amount of steam temporarily required for obtaining the pressure loss coefficient K. The reference amount of steam X0 is measured under the condition that both the pressure P1 inside the can body in the boiler and the pressure P2 on the downstream are at the substantially constant state for eliminating the effects due to the boiler self steam amount and the accumulated heat in the boiler. The "substantially constant state" means that very few pressure variation is present (for example, a pressure variation state within ±several % lasts for a constant period of time). The constant period of time is preferably about 1 minute, and more preferably about 5 to 10 minutes. The validity of the reference amount of steam X0 can be examined by measuring the maximum amount of steam or a constant-load running time for several days based on a graph indicating a continuous change in the steam flow rate obtained by measuring a differential pressure ΔP. If the time when the reference amount of steam X0 is measured is apparently improper, the reference amount of steam X0 may be corrected by judging the top part of the trapezoid where the maximum amount lasts for a constant period of time from the graph.

The coefficient calculating step is a step of calculating a pressure loss coefficient K after the reference amount of steam X0 is obtained, based on the pressure loss calculation equation 1 from the differential pressure ΔP when the reference amount of steam X0 is obtained. More specifically, the pressure loss coefficient K is calculated assuming that the amount of steam X calculated based on the pressure loss calculation equation 1 from the differential pressure ΔP when the reference amount of steam X0 is obtained is equal to the reference amount of steam X0.

The second calculating step will be described below. The calculating step is to obtain a pressure loss coefficient K by flowing a predetermined amount of air into the steam outflow path and substituting the air flow rate X1 and the differential pressure ΔP into the following pressure loss calculation equation 2. The air can be replaced with a fluid (other gas or liquid) instead of steam.

$$\Delta P—K\times X^2\div\rho 1 \quad (2)$$

where ρ1 is an air density.

The second calculating step costs more than the first calculating step, but can be employed according to an implementation. In the second calculating step, a predetermined flow rate of stable gas or the like instead of the steam is flowed in the existing boiler steam outflow pipe, and thus the pressure loss can be measured. The pressure loss can be measured by flowing a predetermined flow rate of air by a compressor in a newly-provided boiler.

Steam Amount Calculating/Outputting Step

The steam amount calculating/outputting step contains a steam amount calculating step and a steam amount outputting step. The steam amount calculating step is a step of continuously calculating the amount of steam X based on the pressure loss coefficient K calculated in the pressure loss coefficient calculating step. Specifically, it is a step of continuously calculating the amount of steam X based on the pressure loss calculation equation 1 from the differential pressure ΔP measured in the differential pressure measuring step and the pressure loss coefficient K calculated in the pressure loss coefficient calculating step.

The steam amount outputting step is a step of outputting the calculated amount of steam X as a measurement value. The outputting method contains a method for reporting a measurement value signal to an alarm such as a display in the steam amount measuring apparatus and a method for transmitting a measurement value signal to a management apparatus separated from the steam amount measuring apparatus.

According to the embodiments described above, the pressure loss coefficient K can be easily calculated from the calculation source data of the reference amount of steam X0. The amount of steam X can be calculated from the differential pressure ΔP directly detecting steam flows, and thus the ever-changing amount of steam X can be measured without a response delay. Further, since the amount of steam X is calculated irrespective of a fuel property value after the pressure loss coefficient K is calculated, the amount of steam X can be more accurately calculated as compared with the conventional methods even when the fuel property value changes.

The steam amount measuring method described above can be applied to a boiler load analyzing method. The load analyzing method measures the maximum amount of used steam in a steam load of the boiler based on the measured amount of steam X. The method can be configured such that a trend of a temporal change in the amount of used steam is measured in addition to the measurement of the maximum amount of used steam in the steam load of the boiler. The method can be configured such that only a trend of a temporal change in the amount of used steam is measured instead of the measurement of the maximum amount of used steam of the boiler. It is desirable that the boiler is stopped after the boiler is activated and a graph indicating a temporal change in the amount of steam X until the pressure inside the can body approaches near 0 is output such that a person can judge both the measurements based on the value of the continuously-measured amount of steam X. Of course, the method can be configured such that the maximum amount of used steam is automatically judged by a controller.

The steam amount measuring method described above is realized by the following steam amount measuring apparatus. The boiler steam amount measuring apparatus configured to continuously measure a temporal change in the amount of steam in a steam boiler comprises:

a differential pressure detecting unit configured to measure a differential pressure ΔP between a pressure at a first detection position as a predetermined position in the can body of the steam boiler or the steam outflow path and a pressure at a second detection position in the steam outflow path separated from the first detection position toward the downstream side; and a controller configured to perform calculating a pressure loss coefficient K based on the differential pressure ΔP measured by flowing a predetermined flow rate of steam or fluid instead of the steam into the steam outflow path, and the predetermined flow rate, continuously calculating the amount of steam X based on the pressure loss calculation equation 1 from the differential pressure ΔP measured by the differential pressure measuring unit and the pressure loss coefficient K calculated, and outputting the calculated amount of steam X as a measurement value.

The steam amount measuring apparatus according to the embodiment preferably comprises a source data measuring unit configured to measure calculation source data of the reference amount of steam X0 from the steam boiler, and is configured such that the pressure loss coefficient calculating step by the controller contains a calculation source data measuring step of measuring calculation source data of the reference amount of steam. X0 of the steam boiler, and a reference steam amount calculating step of obtaining the reference amount of steam X0 based on the measured calculation source data, and a pressure loss coefficient K is calculated based on the pressure loss calculation equation 1 from the differential pressure ΔP when the reference amount of steam X0 is obtained.

The differential pressure detecting unit preferably measures a measurement difference at the same time by two pressure sensors, but may be a well-known differential pressure meter. When the measurements are made at the same time by the two pressure sensors, the pressure sensors, which are of the same kind and the same specification, perform computation processing including pressure-output linear correction based on the signals at the two pressurized points when the burning is stopped (=at the flow rate of zero) such as under no pressure with no burning and during the running or after the driving is stopped, and zero point calibration at least under no pressure.

The source data measuring unit preferably includes a fuel flow meter for measuring a fuel flow rate N or an exhaust gas velocity meter for measuring an exhaust gas flow velocity M, as well as an exhaust gas thermometer and an oxygen concentration meter or carbon dioxide concentration meter for calculating an air ratio (air excess rate).

First Embodiment

Figure 2:
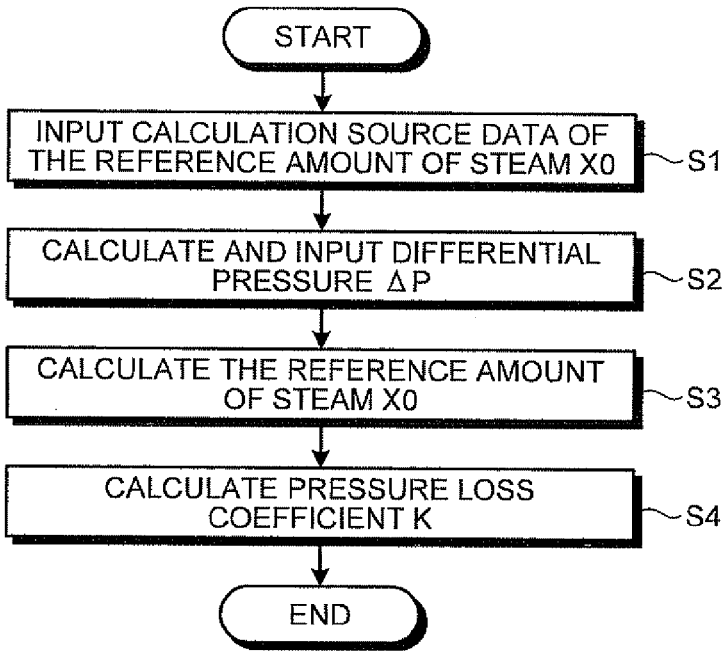
FIG. 2 is an exemplary flowchart for explaining a control program in the first embodiment.
Figure 3:
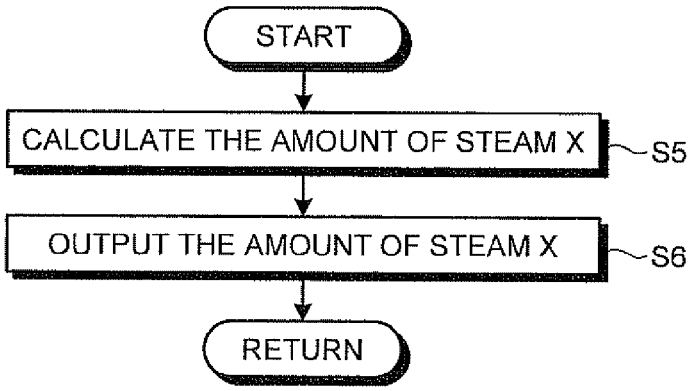
FIG. 3 is an exemplary flowchart for explaining other control program in the first embodiment.
Figure 4:
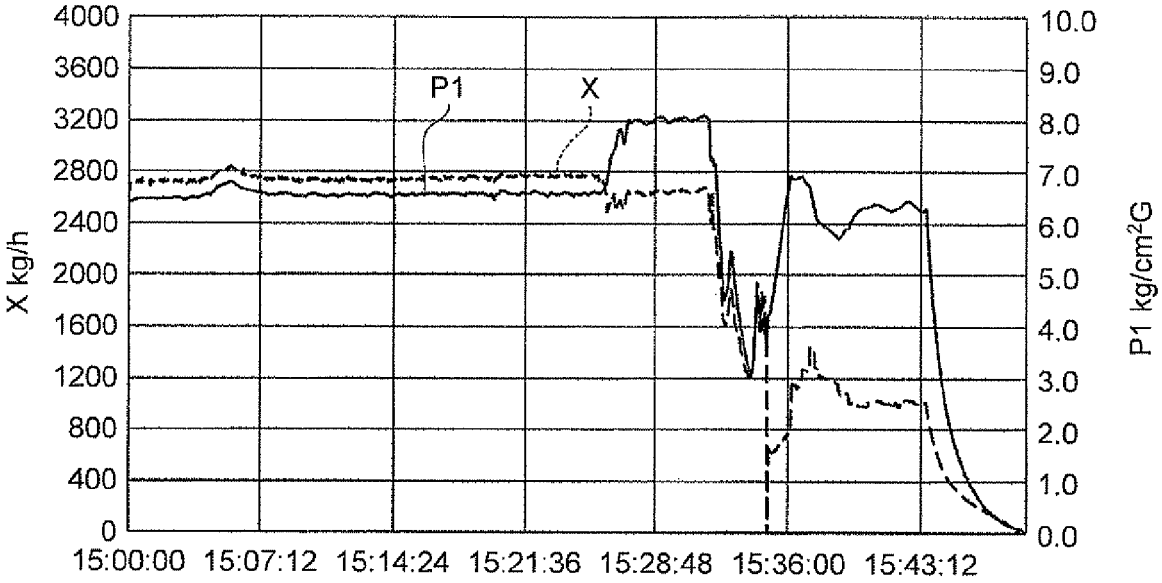
FIG. 4 is an exemplary diagram illustrating temporal changes in a boiler's can body inner pressure and the measured amount of steam in the first embodiment.

A steam amount measuring apparatus 1 according to the first embodiment for implementing the steam amount measuring method according to the present invention will be described below with reference to the drawings. FIG. 1 is a schematic structure diagram of the first embodiment, FIG. 2 is a flowchart for explaining a control program according to the first embodiment, FIG. 3 is a flowchart for explaining other control program according to the first embodiment, and FIG. 4 is a diagram illustrating temporal changes in a pressure P1 inside the can body in the boiler, and the measured amount of steam X according to the first embodiment.

Structure of First Embodiment

The steam amount measuring apparatus 1 according to the first embodiment is an apparatus for measuring the amount of steam X (a steam flow rate of a steam outflow path 3A) in a steam boiler (which will be simply called boiler below) 2. The steam amount measuring apparatus 1 comprises, as main parts, a differential pressure detecting unit 4, a source data measuring unit 5, and a controller 6 for controlling a measurement of the amount of steam X.

The differential pressure detecting unit 4 includes a first pressure sensor 8 and a second pressure sensor 9 for measuring a differential pressure ΔP between a pressure at a first detection position inside a can body 7 of the boiler 2, and a pressure at a second detection position in the steam outflow path 3A separated from the first detection position toward the downstream side. The first pressure sensor 8 is directed for detecting a first pressure P1 inside the can body 7 of the boiler 2 at the first detection position. The second pressure sensor 9 is directed for detecting a second pressure P2 inside a steam header 10 at the second detection position in the steam outflow path 3A. The differential pressure ΔP is P1-P2. The first pressure sensor 8 and the second pressure sensor 9 can be attached similarly to a conventional pressure meter. Existing pressure sensors may be used, but the sensors of the same kind (the signal-pressure linearity is of the same semiconductor, electrostatic capacity or magnetostriction) and the same specification are used. The steam header 10 is connected to steam outflow paths 3B, 3B, . . . for distributing steam to a plurality of steam loads (not illustrated).

The pressure sensors 8 and 9 of the same kind and the same specification are configured to perform, as needed, the computation processing including the pressure-output linear correction based on the signals at the two points under no pressure without burning and under a pressurized force, and zero-point calibration under no pressure.

The source data measuring unit 5 is a unit configured to measure calculation source data of the reference amount of steam X0, and in the first embodiment, includes the pressure sensors 8, 9, an exhaust gas velocity meter 12 configured to measure an exhaust gas flow velocity M inside an exhaust gas flow path 11, an exhaust gas oxygen concentration meter 13 configured to measure an oxygen concentration in exhaust gas, an exhaust gas thermometer 14 configured to measure a temperature of exhaust gas, a supplied air thermometer 15 configured to measure a temperature of supplied air, and a supplied water thermometer 16 configured to measure a temperature of supplied water. The previously-provided unit in the boiler 2 among the measuring units is utilized as needed without being newly provided.

The controller 6 is configured to input signals from the first pressure sensor 8, the second pressure sensor 9 and each measurement meter in the source data measuring unit 5 and to output the measured amount of steam X to a display 17 based on the previously-stored control procedures (control program). Exemplary control procedures are illustrated in FIGS. 2 and 3.

The control procedures by the controller 6 include a pressure loss coefficient calculating procedure illustrated in FIG. 2, and a steam amount calculating/outputting procedure (which can be called steam amount measuring procedure) illustrated in FIG. 3. The pressure loss coefficient calculating procedure includes a calculation source data inputting step of inputting calculation source data (a signal from each measurement meter in the source data measuring unit 5), a differential pressure inputting step of inputting a differential pressure ΔP (a difference between the detected pressure P1 by the first pressure sensor 8 and the detected pressure P2 by the second pressure sensor 9), a reference steam amount calculating step of obtaining the reference amount of steam X0 based on the calculation source data, and a coefficient calculating step of calculating a pressure loss coefficient K assuming that the amount of steam X calculated based on the pressure loss calculation equation in the following equation 1 from the differential pressure ΔP when the reference amount of steam X0 is obtained is equal to the reference amount of steam X0.

$$\Delta P = K \times X^2 + \rho \tag{1}$$

where ρ is a steam weight volume ratio obtained based on P1.

The steam amount calculating/outputting procedure includes a steam amount calculating step of continuously calculating the amount of steam X based on the pressure loss calculation equation (Equation (1)) from the differential pressure ΔP input in the differential pressure inputting step and the pressure loss coefficient K calculated in the coefficient calculating step, and a steam amount outputting step of outputting the calculated amount of steam X as a measurement value to the display 17.

Numerals 18, 19, 20 and 21 in FIG. 1 indicate a burner, a burning air flow path to the burner 18, a fuel flow path to the burner 18 and a water supply path to the can body 7, respectively.

Operations of First Embodiment

The operations of the first embodiment will be described below with reference to the drawings. Now it is assumed that the amount of steam X from the previously-provided boiler 2 is measured by use of the steam amount measuring apparatus 1. At first, while the running of the boiler 2 is being stopped, the first pressure sensor 8, the second pressure sensor 9, the exhaust gas velocity meter 12, the exhaust gas oxygen concentration meter 13, the exhaust gas thermometer 14, the supplied air thermometer 15 and the supplied water thermometer 16 are attached as illustrated in FIG. 1. In this state, the boiler 2 starts running and an activation switch (not illustrated) in the steam amount measuring apparatus 1 is powered on to start measuring.

Calculation of Pressure Loss Coefficient K

At first, the calculation of a pressure loss coefficient K will be described. The calculation of a pressure loss coefficient K is made when the pressure of the can body 7 or the pressure P1 of the first pressure sensor 8 is stable. Specifically, the calculation of a pressure loss coefficient K is made when a person making measurements, who operates the steam amount measuring apparatus 1, observes the P1 output, determines that the pressure is stable when a variation in the pressure is within ±several % or less in successive 5 minutes, and powers on a coefficient calculation switch (not illustrated). Of course, the stability and the coefficient calculation switch can be automatically determined and operated, respectively.

With reference to FIG. 2, the controller 6 takes a signal from each measurement device in the source data measuring unit 5 in step S1 (step SN will be simply called SN below). Then, a differential pressure ΔP is calculated and input in S2.

Then, in S3, the reference amount of steam X0 is calculated in Equation (3) based on an average value of the values sampled from the measurement data for the last 5 minutes by the source data measuring unit 5. Herein, a case with a gas fuel is indicated.

$$X0=(\eta\times HL\times N)/(h1-h2) \quad (3)$$

where X0: the reference amount of steam (kg/h), η: boiler efficiency (%), HL: fuel lower heating value (Kcal/$m^3$N), N: fuel flow rate ($m^3$N/h), h1: saturated steam enthalpy (kcal/kg), h2: supplied water enthalpy (kcal/kg)

The fuel flow rate N is calculated in Equation (4).

$$N=Y1/\{G0+Gw+(m-1)\times A0\} \quad (4)$$

where Y1: exhaust gas standard flow rate ($m^3$N/h), (G0+Gw+(m−1)×A0): the amount of actual wet exhaust gas ($m^3$N/$m^3$N, fuel)

G0: the amount of theoretical dry exhaust gas ($m^3$N/$m^3$N, fuel),

Gw: the amount of water steam due to water steam generated by burning and wafer during burning ($m^3$N/$m^3$N, fuel), (G0+Gw): the amount of theoretical exhaust gas ($m^3$N/$m^3$N, fuel).

A0: the amount of theoretical air ($m^3$N/$m^3$N, fuel), m: air ratio

The exhaust gas standard flow rate Y1 is calculated in the following Equation (5).

$$Y1=Y2\times 273/(273+T1) \quad (5)$$

where Y2: exhaust gas actual flow rate ($m^3$/h), T1: exhaust gas temperature (° C.) measured by the exhaust gas thermometer 14

The exhaust gas actual flow rate Y2 is calculated in the following Equation (6).

$$Y2=M\times S\times 3600 \quad (6)$$

where M: exhaust gas flow velocity (m/s) measured by the exhaust gas velocity meter 12, S: cross section area ($m^2$) of exhaust gas flow path Eventually, the reference amount of steam X0 can be calculated by the exhaust gas flow velocity M obtained from the measurement signal by the exhaust gas velocity meter 12.

Then, in S4, a pressure loss coefficient K is calculated assuming that the reference amount of steam X0 calculated in S3 is equal to the amount of steam X (Equation (1)) obtained from the differential pressure ΔP when the reference amount of steam X0 is calculated, that is, X0=X. The values other than the pressure loss coefficient K are obtained, and thus the pressure loss coefficient K can be calculated based on X0=X.

Calculation and Output of the Amount of Steam

Then, the steam amount calculating/outputting procedure, or the steam amount measuring procedure will be described. With reference to FIG. 3, in S5, the amount of steam X is continuously calculated by substituting the pressure loss coefficient K calculated in S4 and the continuously measured differential pressure ΔP into Equation (1). In S6, the calculated amount of steam X is output to the display 17 as illustrated in FIG. 4, for example. FIG. 4 illustrates exemplary temporal changes in the pressure P1 inside the can body as a measurement value and the amount of steam X calculated in Equation (1). The value on the horizontal axis (time axis) in FIG. 4 indicates hour/minute/second.

According to the above first embodiment, the pressure loss coefficient K can be easily calculated based on the calculation source data of the reference amount of steam X0 even in the boiler 2 not comprising the fuel flow meter in the fuel flow path 20. The first pressure sensor 8 and the second pressure sensor 9 directly detect the steam flows to calculate the amount of steam X based on the differential pressure ΔP, and thus can measure the ever-changing amount of steam X without a response delay. Further, since the amount of steam X is calculated irrespective of the fuel property value after the pressure loss coefficient K is calculated, the amount of steam X can be more accurately calculated as compared with the conventional methods even when the fuel property value changes. The effect is particularly conspicuous when coal or biofuel, which is unstable in fuel property, is used as a fuel of the boiler, or when a control variation of the boiler is large.

Second Embodiment

Figure 5:
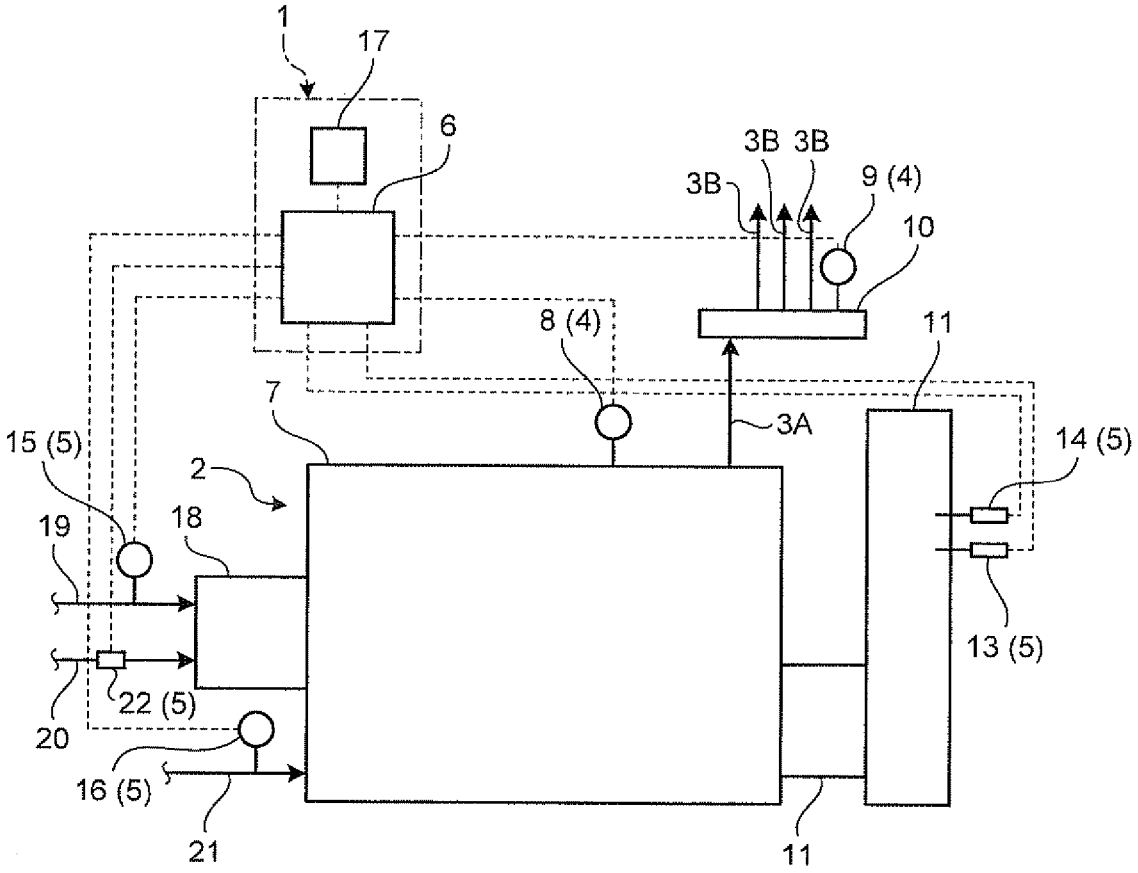
FIG. 5 is an exemplary schematic structure diagram of a steam amount measuring apparatus according to a second embodiment of the present invention.

The present invention is not limited to the first embodiment, and may contain a second embodiment illustrated in FIG. 5. The second embodiment is different from the first embodiment in that a fuel flow meter 22 is provided in the fuel flow path 20, and other constituents are the same as those in the first embodiment, and thus the same constituents are denoted with the same reference numerals and an explanation thereof will be omitted.

In the second embodiment, the calculation source data of the reference amount of steam X0 in S1 in FIG. 2 is a fuel flow rate N measured by the fuel flow meter 22, and the reference amount of steam X0 can be obtained without measuring an exhaust gas flow velocity M, unlike the first embodiment. An oxygen concentration, an exhaust gas temperature, a steam pressure, a supplied water temperature and the like are measured similarly as in the first embodiment.

The present invention is not limited to the first and second embodiments, and may be variously changed. For example, the calculation source data is input from the sensor to the controller 6 online in the first and second embodiments, but the calculation source data such as the exhaust gas flow velocity M of the exhaust gas velocity meter 12 may be read by a person and manually (offline) input into the controller 6. The steam amount measuring method according to the present invention is used not only for an apparatus for temporarily making measurements for grasping the amount of steam in a previously-provided boiler, but also for an apparatus for continuously making measurements for managing or controlling a boiler.

According to the embodiments, a boiler steam amount measuring method for continuously measuring a temporal change in an amount of steam from a steam boiler, comprises: first measuring a differential pressure between a pressure at a first detection position that is a predetermined position in a can body of the steam boiler or a steam outflow path of the steam boiler, and a pressure at a second detection position in the steam outflow path separated from the first detection position toward a downstream side of the steam boiler; first calculating a pressure loss coefficient based on the differential pressure measured by flowing a predetermined flow rate of steam or fluid instead of steam into the steam outflow path, and the predetermined flow rate; and second calculating continuously the amount of steam based on the differential pressure measured in the first measuring and the pressure loss coefficient calculated in the first calculating to output the calculated amount of steam as a measurement value.

According to the embodiments, it is possible to measure the ever-changing amount of steam without a response delay not by using a steam flow meter, and to more accurately calculate the amount of steam even when a fuel property value changes after a pressure loss coefficient is calculated as compared with the conventional methods.

According to the embodiments, the steam flows are directly detected to calculate the amount of steam based on the differential pressure so that the ever-changing amount of steam can be measured without a response delay, and the amount of steam is calculated irrespective of the fuel property value after the pressure loss coefficient is calculated so that the amount of steam can be more accurately calculated as compared with the conventional methods even when the fuel property value changes.

In the embodiments, the calculating includes: second measuring calculation source data of a reference amount of steam from the steam boiler; obtaining the reference amount of steam based on the measured calculation source data; and third calculating the pressure loss coefficient based on the differential pressure when the reference amount of steam is obtained.

According to the embodiments, there is obtained an effect that the pressure loss coefficient can be easily calculated.

In the embodiments, the calculation source data is a fuel flow rate in a fuel flow path to the steam boiler or an exhaust gas flow velocity in an exhaust gas flow path from the steam boiler.

According to the embodiments, there is obtained an effect that the reference amount of steam can be more easily calculated based on the fuel flow rate or the exhaust gas flow velocity.

In the embodiments, a boiler load analyzing method using the steam amount measuring method, comprises: third measuring a maximum amount of steam used and/or a trend of a temporal change in an amount of steam used in a steam load of the steam boiler.

According to the embodiments, there can be accurately performed the measurement of the maximum amount of used steam and/or the measurement of the trend of the temporal change in the actual amount of used steam in the steam load of the steam boiler on the basis of the amount of steam output by the steam amount measuring method.

According to the embodiments, a boiler steam amount measuring apparatus configured to continuously measure a temporal change in an amount of steam from a steam boiler, comprises: a differential pressure detecting unit configured to measure a differential pressure between a pressure at a first detection position that is a predetermined position in a can body of the steam boiler or a steam outflow path of the steam boiler, and a pressure at a second detection position in the steam outflow path separated from the first detection position toward a downstream side of the steam boiler; and a controller configured to perform first calculating a pressure loss coefficient based on the differential pressure measured by flowing a predetermined flow rate of steam or fluid instead of steam into the steam outflow path, and the predetermined flow rate, and second calculating continuously the amount of steam based on the differential pressure measured by the differential pressure detecting unit and the pressure loss coefficient calculated in the first calculating to output the calculated amount of steam as a measurement value.

According to the embodiments, there can be provided the boiler steam amount measuring apparatus capable of measuring the ever-changing amount of steam without a response delay not by using the steam flow meter, and more accurately calculating the amount of steam even when the fuel property value changes after the pressure loss coefficient is calculated as compared with the conventional methods.

In the embodiments, the boiler steam amount measuring apparatus further comprises a source data measuring unit configured to measure calculation source data of a reference amount of steam from the steam boiler, wherein the first calculating by the controller includes: obtaining the reference amount of steam based on the measured calculation source data; and third calculating the pressure loss coefficient based on the differential pressure when the reference amount of steam is obtained.

According to the embodiments, the pressure loss coefficient can be easily calculated.

In the embodiments, the source data measuring unit is a fuel flow meter configured to measure a fuel flow rate in a fuel flow path to the steam boiler or an exhaust gas velocity meter configured to measure an exhaust gas flow velocity in an exhaust gas flow path from the steam boiler.

According to the embodiments, there is obtained an effect that the reference amount of steam can be more easily measured by the fuel flow meter or the exhaust gas velocity meter.

In the embodiments, a boiler load analyzing apparatus comprising the steam amount measuring apparatus is configured to measure a maximum amount of steam used and/or a trend of a temporal change in an amount of steam used in a steam load of the steam boiler.

According to the embodiments, there can be provided the boiler load analyzing apparatus capable of measuring the ever-changing amount of steam without a response delay not by using the steam flow meter, and more accurately calculating the amount of steam even when the fuel property value changes after the pressure loss coefficient is calculated as compared with the conventional methods, thereby making a load analysis.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A boiler steam amount measuring method for continuously measuring a temporal change in an amount of steam from a steam boiler without using a steam flow meter, comprising:

first measuring a differential pressure between a pressure at a first detection position that is a predetermined position in a can body of the steam boiler or a steam outflow path of the steam boiler, and a pressure at a second detection position in the steam outflow path separated from the first detection position toward a downstream side of the steam boiler;

first calculating a pressure loss coefficient based on the differential pressure measured by flowing a predetermined flow rate of steam into the steam outflow path, and the predetermined flow rate, the first calculating the pressure loss coefficient including:

second measuring calculation source data of a reference steam amount X0 from the steam boiler;

obtaining the reference steam amount X0 based on the measured calculation source data; and second calculating the pressure loss coefficient based on:

(i) the reference steam amount X0;

(ii) the differential pressure when the reference steam amount X0 is obtained; and (iii) a steam weight volume ratio obtained based on the pressure at the first detection position; and third calculating continuously the amount of steam based on the differential pressure measured in the first measuring and the pressure loss coefficient calculated in the first calculating to output the calculated amount of steam as a measurement value.

2. The boiler steam amount measuring method according to claim 1, wherein the calculation source data is a fuel flow rate in a fuel flow path to the steam boiler or an exhaust gas flow velocity in an exhaust gas flow path from the steam boiler.

3. A boiler load analyzing method using the steam amount measuring method according to claim 1, comprising:

third measuring a maximum amount of steam used and/or a trend of a temporal change in an amount of steam used in a steam load of the steam boiler.

4. A boiler steam amount measuring apparatus configured to continuously measure a temporal change in an amount of steam from a steam boiler without a steam flow meter provided, comprising:

a differential pressure detecting unit configured to measure a differential pressure between a pressure at a first detection position that is a predetermined position in a can body of the steam boiler or a steam outflow path of the steam boiler, and a pressure at a second detection position in the steam outflow path separated from the first detection position toward a downstream side of the steam boiler; and a controller configured to perform:

first calculating a pressure loss coefficient based on the differential pressure measured by flowing a predetermined flow rate of steam into the steam outflow path, and the predetermined flow rate, the first calculating the pressure loss coefficient including:

second measuring calculation source data of a reference steam amount X0 from the steam boiler;

obtaining the reference steam amount X0 based on the measured calculation source data; and second calculating the pressure loss coefficient based on:

(i) the reference steam amount X0;

(ii) the differential pressure when the reference steam amount X0 is obtained; and (iii) a steam weight volume ratio obtained based on the pressure at the first detection position; and third calculating continuously the amount of steam based on the differential pressure measured by the differential pressure detecting unit and the pressure loss coefficient calculated in the first calculating to output the calculated amount of steam as a measurement value.

5. The boiler steam amount measuring apparatus according to claim 4, wherein the source data measuring unit is a fuel flow meter configured to measure a fuel flow rate in a fuel flow path to the steam boiler or an exhaust gas velocity meter configured to measure an exhaust gas flow velocity in an exhaust gas flow path from the steam boiler.

6. A boiler load analyzing apparatus comprising the steam amount measuring apparatus according to claim 4, wherein the boiler load analyzing apparatus is configured to measure a maximum amount of steam used and/or a trend of a temporal change in an amount of steam used in a steam load of the steam boiler.

* * * * *